US005465836A

United States Patent [19]

Focke

[11] Patent Number: 5,465,836

[45] Date of Patent: Nov. 14, 1995

[54] PACK FOR CIGARETTES

[75] Inventor: Heinz Focke, Verden, Germany

[73] Assignee: Focke & Co. (GmbH & Co.), Verden, Germany

[21] Appl. No.: 212,929

[22] Filed: Mar. 15, 1994

Related U.S. Application Data

[63] Continuation-in-part of Ser. No. 941,799, Sep. 8, 1992, Pat. No. 5,325,963.

[30] Foreign Application Priority Data

Sep. 6, 1991 [DE] Germany ..... 41 29 609.5

[51] Int. Cl.[6] ..... B65D 5/66

[52] U.S. Cl. ..... 206/264; 206/268; 206/273

[58] Field of Search ..... 206/268, 260, 206/264, 265, 271, 273, 274

[56] References Cited

U.S. PATENT DOCUMENTS

| | | | |
|---|---|---|---|
| 3,090,541 | 5/1963 | Janda | 206/268 |
| 3,298,590 | 1/1967 | Gray | 206/268 |
| 3,391,780 | 7/1968 | Pasquine et al. | 206/268 |
| 4,049,117 | 9/1977 | Grimm . | |
| 4,165,804 | 8/1979 | Georgopoulos | 206/259 |

FOREIGN PATENT DOCUMENTS

| | | | |
|---|---|---|---|
| 1250553 | 2/1989 | Canada . | |
| 411223 | 2/1991 | European Pat. Off. . | |
| 476882 | 3/1992 | European Pat. Off. | 206/268 |
| 1167258 | 4/1964 | Germany . | |
| 1904793 | 9/1964 | Germany . | |
| 1586855 | 12/1971 | Germany . | |
| 2540221 | 9/1975 | Germany . | |
| 2551427 | 5/1977 | Germany . | |
| 3335967 | 4/1985 | Germany . | |
| 579366 | 9/1976 | Switzerland . | |
| 942424 | 11/1963 | United Kingdom | 206/265 |
| 961558 | 6/1964 | United Kingdom . | |
| 2024162 | 1/1980 | United Kingdom . | |
| 2101565 | 1/1983 | United Kingdom . | |
| 2106869 | 4/1983 | United Kingdom . | |
| WO9014278 | 11/1990 | WIPO . | |

*Primary Examiner*—Jacob K. Ackun
*Attorney, Agent, or Firm*—Sughrue, Mion, Zinn, Macpeak & Seas

[57] ABSTRACT

Hinge lid packs without outer wrapping have been offered in the market recently. The mechanical production of hinge lid packs is complex because the common collar is produced from a separate blank. In the hinge lid pack according to the invention, the pack part (18) and the lid (19) are connected to one another by residual connections (38, 39) made from the packaging material. These residual connections (38, 39) are severable when the lid (19) is opened for the first time. Preferably, the collar (15) is connected to the lid (19) via the residual connections (38, 39).

13 Claims, 4 Drawing Sheets

PACK FOR CIGARETTES

This application is a continuation in part of application Ser. No. 07/941,799 filed Sep. 8, 1992, now U.S. Pat. No. 5,325,963.

DESCRIPTION

BACKGROUND OF THE INVENTION

The invention relates to a hinge lid pack for a group of cigarettes (cigarette group) or the like, comprising a pack part having a lid hinged thereto, and a collar having a collar front wall and collar side walls, the collar, with a part region, being fixedly connected to the pack part, and the upper portion of the collar being surrounded by the lid in the closed position.

Hinge lid packs are used for packaging cigarettes throughout the world. The pack content, namely a cigarette group, is surrounded by an inner wrapping made of tin foil or paper and forms a cigarette block. The hinge lid pack is wrapped in an outer wrapping made of plastic film. Recently, hinge lid packs without an outer wrapping have been offered in the market.

The mechanical production of hinge lid packs is complex, not least owing to the fact that the common collar is made from a separate blank.

SUMMARY OF THE INVENTION

The object of the invention is to design a hinge lid pack for cigarettes or other goods, or a blank for this pack type, in such a manner that less material is wasted in the production and the handling of the hinge lid pack is improved.

To attain this object, the hinge lid pack according to the invention is characterized in that the pack part and the lid are connected to one another by residual connections made from the packaging material, which are severable when opening the lid for the first time.

Preferably, the hinge lid pack, or the blank for the same, is designed in such a manner that the blank of the collar is connected, via residual connections of the material of the blanks, to an inner lid tab which adjoins the inner side of a lid front wall in the finished pack and which is connected thereto.

The blank for the hinge lid pack according to the invention is designed in the conventional manner. Merely in the region of the lid, specifically in the region of the inner lid tab, a design which differs from the one-piece arrangement of the collar is chosen. The collar reaches the appropriate position for packaging within the pack part by simple folding processes. The collar is fixed inside the pack part by means of adhesive bonding. The residual connections preferably remain intact until the pack is opened for the first time. When lifting the lid, the inner residual connections are separated. The hinge lid pack can then be used just as conventional embodiments.

The residual connections between the collar and the lid have the further important advantage that unauthorized or unintentional opening before using of the same is impeded. This is advantageous in hinge lid packs offered without outer wrappings. Unintentional opening of the pack is prevented by the residual connections.

The entire blank for the hinge lid pack and the collar can be manufactured with minimum waste if it is designed accordingly. The handling of a packaging machine is facilitated, because only a one-piece blank has to be processed for the entire hinge lid pack.

BRIEF DESCRIPTION OF THE DRAWINGS

Further details of the hinge lid pack or the blank are explained below with reference to the drawings. In these.

DETAILED DESCRIPTION OF THE PREFERRED EMBODIMENTS

Figure 2:
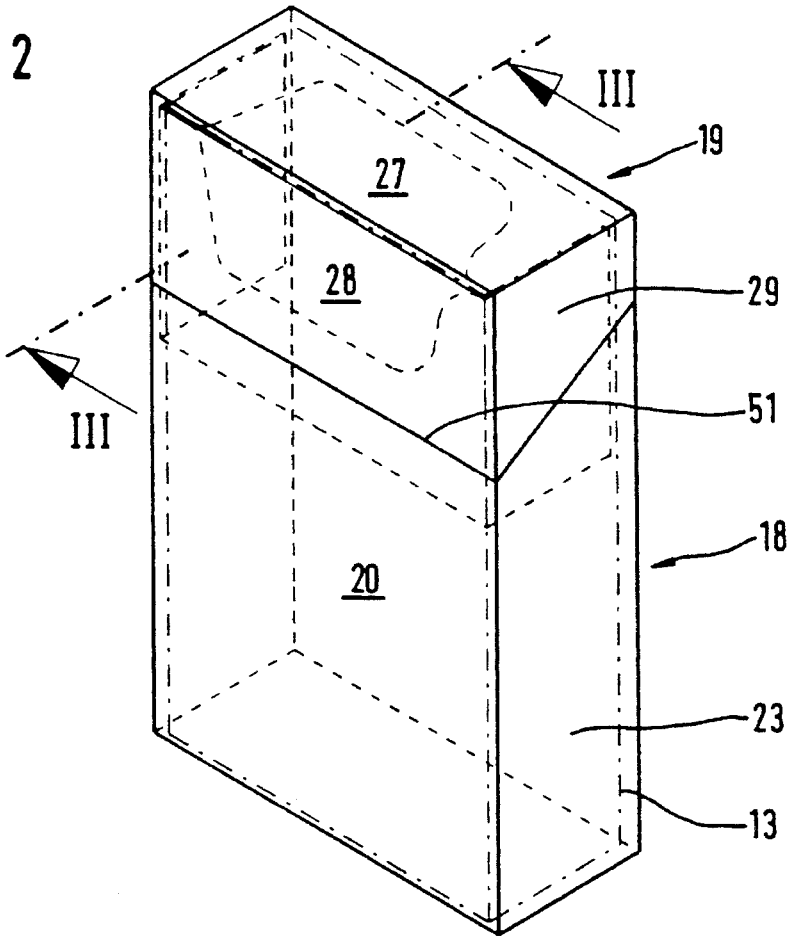
FIG. 2 shows a perspective view of a closed hinge lid pack

The exemplary embodiments in the drawings relate to hinge lid packs which are, in particular, intended for accommodating cigarettes. The content of a hinge lid pack (FIG. 2 to FIG. 4) comprises a cigarette group 11, which may be surrounded by an inner wrapper 12 made from tin foil or paper. In this manner, a cigarette block 13 is formed as the pack content. For the sake of simplicity, the inner wrapping 12 is omitted in FIG. 3.

Figure 1:
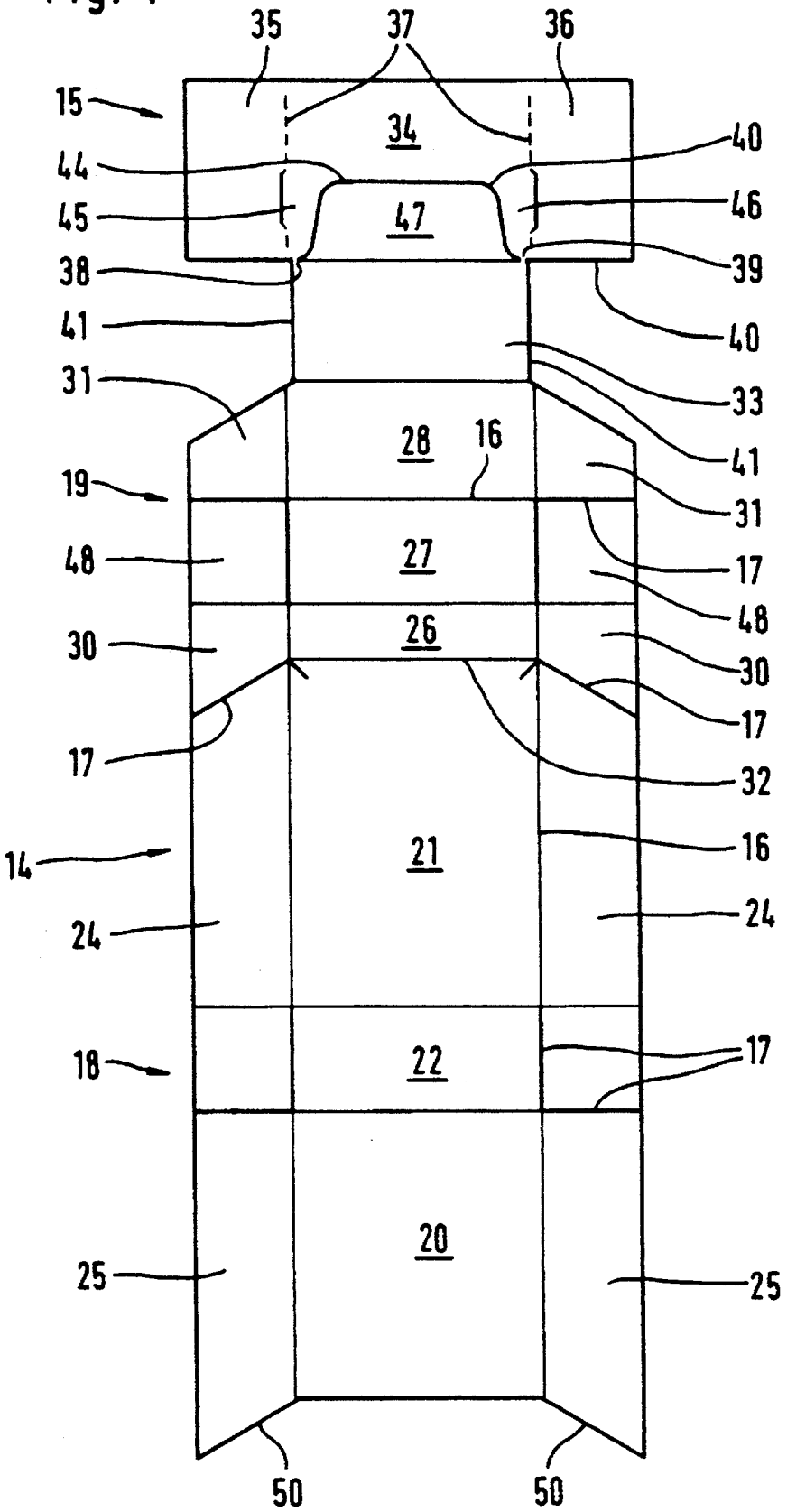
FIG. 1 shows a spread-out blank for a hinge lid pack
Figure 5:
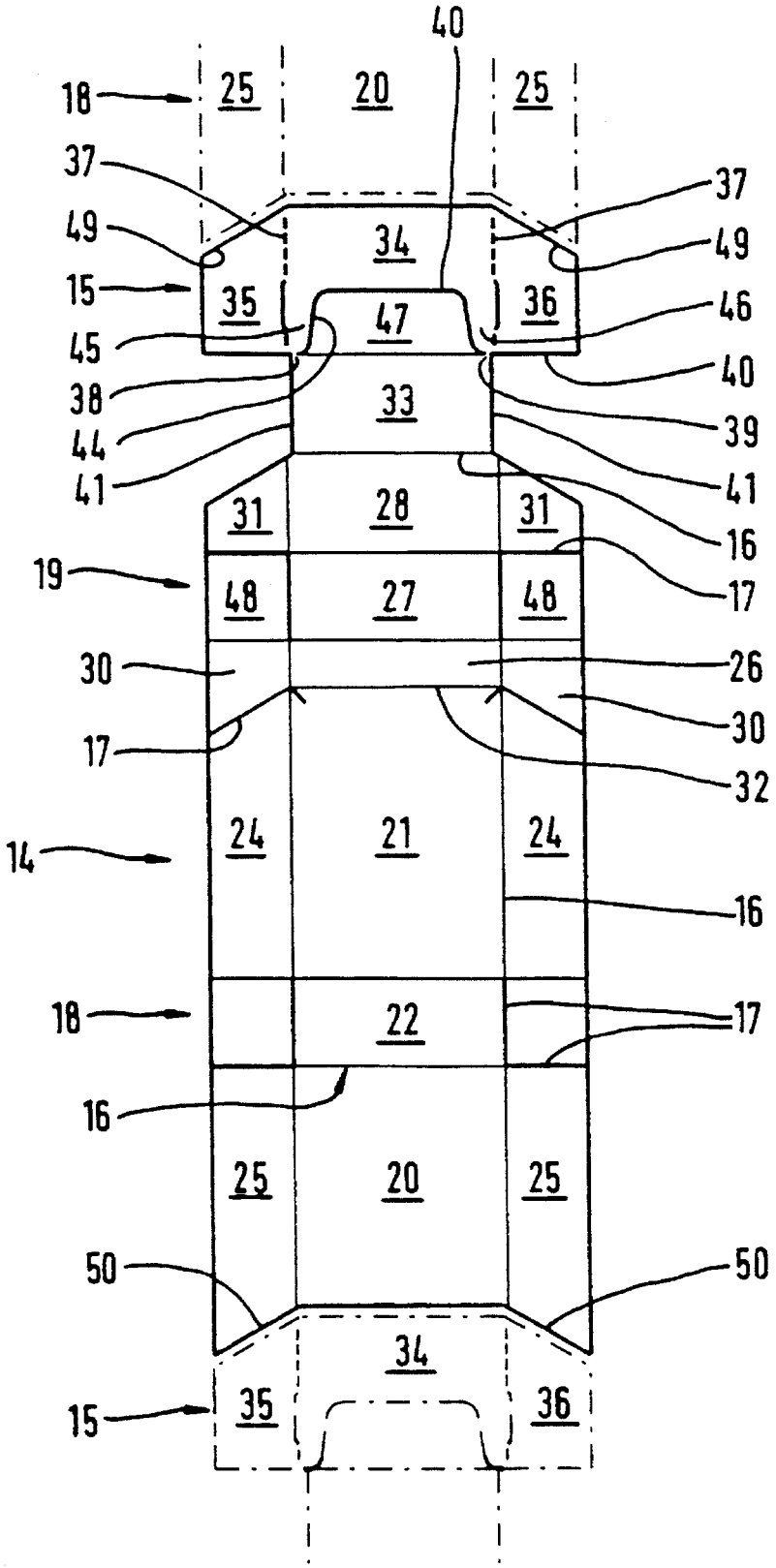
FIG. 5 shows a further embodiment of a blank according to FIG. 1.

The hinge lid pack itself is made of a one-piece blank according to FIG. 1 or FIG. 5. A main blank 14 serves for the production of the hinge lid pack. A collar 15 is connected to this main blank in one piece. The entire blank is conventionally made from thin cardboard.

The main blank 14 has prefabricated longitudinally and transversely extending folding lines 16 and cutout punches 17 for forming a (lower) pack part 18 and a lid 19. The pack part has a front wall 20, a rear wall 21, a bottom wall 22 and side walls 23. The latter are formed, in the present example, by two mutually covering side tabs 24, 25 which are connected to one another by adhesive bonding.

The lid 19 has a lid rear wall 26, an upper lid wall 27, a lid front wall 28 and lid side walls 29. The latter are formed, similar to the side walls 23, by mutually covering lid side tabs 30, 31, which are connected to one another by adhesive bonding.

The lid 19, in the region of the lid rear wall 26, is pivotably connected to the pack part 18, specifically to the rear wall 21 of the same, by a transversely directed articulated line 32.

Figure 3:
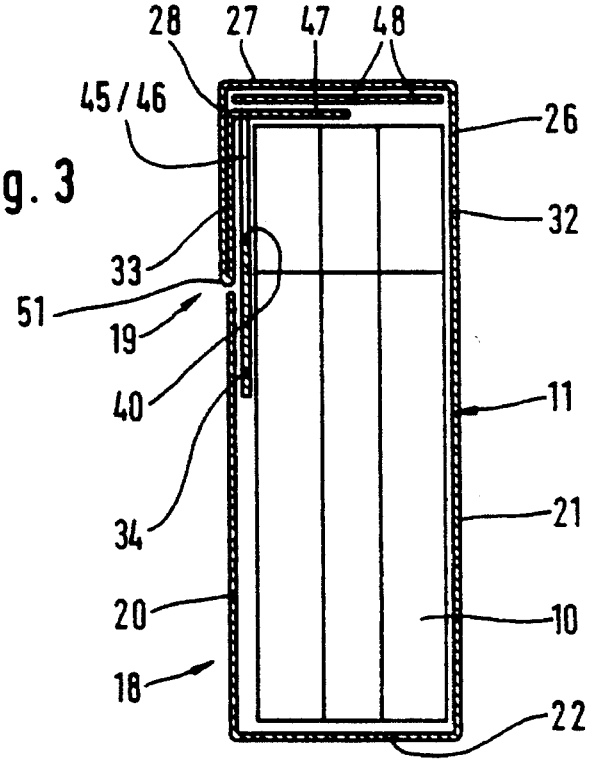
FIG. 3 shows a vertical section through a hinge lid pack according to FIG. 2 taken along the planes III—III

An inner lid tab is arranged at the free side of the lid front wall 28. This inner lid tab 33, in the finished hinge lid pack, is folded against the lid front wall 28 and connected thereto, for example by adhesive bonding (FIG. 3). The inner lid tab 33 extends, in the present case, almost across the entire width and height of the lid front wall 28. The inner lid tab 33 and the lid front wall 28 form a bordering edge 51 of the lid 19 in the region of the lid front wall 28.

The collar 15 is connected in one piece to the main blank designed in the described manner. The collar has, as usual, a collar front wall 34 and collar side tabs 35, 36. The width of the so designed collar 15 approximately corresponds to the width of the main blank 14. In the finished hinge lid pack, the collar 15, with a lower portion, is seated in the pack part 18 in the region of the front wall 20 and the side walls 23. For this purpose, the collar 34 is delimited from the collar side walls 35, 36 by folding edges 37, which are shown as dotted lines in FIG. 1.

The collar 15 is connected to the main blank 14 merely by a few, small material webs or residual connections 38, 39. These residual connections 38, 39 are formed in the region of an upper edge 40 of the collar 15 in the region of the collar front wall 34, directly next to the folding edges 37. Thereby, a connection of the collar 15 with the inner lid tab 33 is created, specifically directly next to the side edges 41 of the inner lid tab 33.

In the finished pack, the residual connections 38, 39 extend along the edge of the inner lid tab 33, which points upwards and extends adjacent to the upper lid wall 27. The residual connections 38, 39 form a folding edge, because the collar front wall 34 adjoins the inner lid tab 33.

Figure 4:
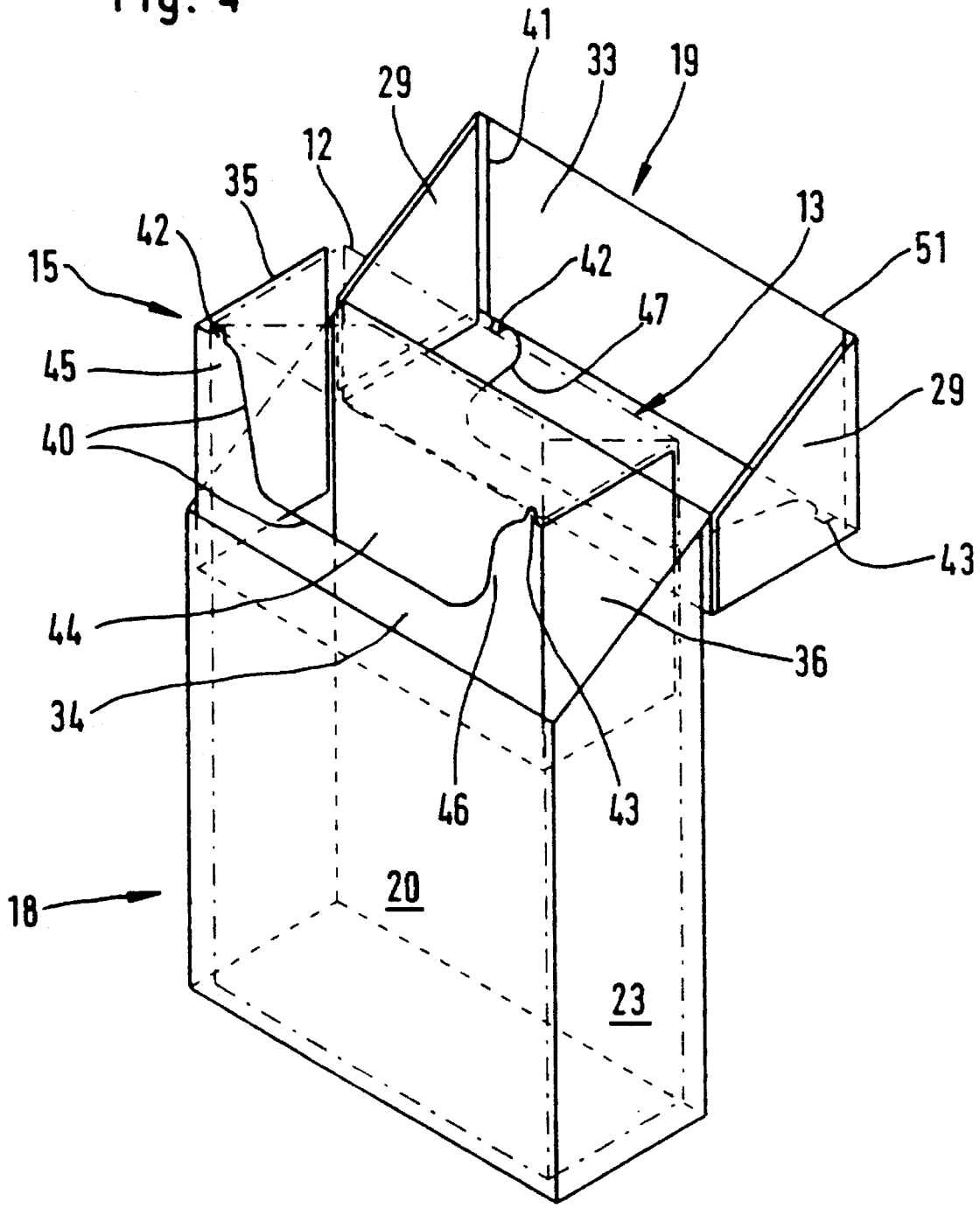
FIG. 4 shows a hinge lid pack according to FIG. 2 in the open position, also in a perspective view.

In the finished hinge lid pack, a connection is formed by the residual connections 38, 39 between the collar 15 which is connected to the pack part 18, on the one hand, and the lid 19, on the other, specifically in the inner region which is invisible from the outside. The residual connections 38, 39 are severed when opening the hinge lid pack (FIG. 4). Small, unobtrusive material projections 42, 43 are created at the upper edge of the collar front wall 34.

A collar 15, conventional in hinge lid packs, has a special outline in the region of the collar front wall 34. In this region, the upper edge 40 defines a recess 44 in the central region of the collar front wall 34 for facilitating the withdrawal of the cigarettes. The recess 44 is limited by lateral, upright webs 45, 46. The residual connections 38, 39 are formed in the region of the webs 45, 46.

In order to form the recess 44 without producing waste, a folding tab 47 adjoins the inner lid tab 33 in the central region and the outer shape of the folding tab 47 corresponds to the shape of the outline of the edge 40, and thus to the outline of the collar front wall 34. The folding tab 47 has a smaller width than the inner lid tab 34, so that the residual connections 38, 39 can be formed next to the folding tab 47. The outline of the collar front wall 34, on the one hand, and the folding tab 47, on the other, is formed by a common punch cut which leaves only the residual connections 38, 39 untouched. In the finished hinge lid pack (FIG. 2, FIG. 3), the folding tab 47 is folded against the inner side of the upper lid wall 27 or against the lid corner tabs which, in this region, directly adjoin the upper lid wall 27.

FIG. 5 shows a slightly modified embodiment of the blank for such a hinge lid pack. The collar 15 is designed with inclined edges 49 in the region of the collar side tabs 35, 36. The inclined edges 49 correspond to the inclined edges 50 at the opposite side of the blank in the region of side tabs 25. As a result of this adapted design of the collar 15, the blanks, as indicated in dotted lines, can be punched out of a web of material or sheet of material with very little waste of material.

I claim:

1. A hinge-lid pack for a group of cigarettes (10), comprising:

a pack part (18) and a lid (19) hinged thereto; and a collar (15) having a collar from wall (34) and collar side tabs (35, 36), the collar (15) being surrounded by the lid (19) in a closed position of the lid;

wherein the collar (15) and the lid (19) are connected to one another by residual connections (38, 39) which are made from packaging material, and which are severable when opening the lid (19) for the first time, and wherein the residual connections (38, 39) are formed at an upper free edge (40) of the collar and connect the collar with a lid inner tab (33) which adjoins the inner side of a lid front wall (28).

2. The hinge lid pack as claimed in claim 1, wherein the residual connections (38, 39) are formed at a free lateral edge of the lid inner tab (33), which extends in the lid (19) adjacent to a lid upper wall (27).

3. A blank for the production of hinge-lid packs for the accommodation of cigarettes (10), with a main blank (14) forming a pack part (18) and a lid (19) connected to the pack pan, the lid being provided with a lid front wall (28) and an lid inner tab (33) connected to the inner side of the lid-front wall (28), and the lid inner tab (33) adjoining the inner side of the lid front wall (28) in a pack to be produced, wherein a collar (15), having a collar front wall (34) and collar side tabs (35, 36), is connected in one-piece to the lid inner tab (33) via two residual connections (38, 39).

4. The blank as claimed in claim 3, wherein the two residual connections (38, 39) are formed adjacent to lateral edges (41) of the lid inner tab (33) and are connected to an upper edge (40) of the collar (15) in a region of the collar from wall (34).

5. The blank as claimed in claim 3, wherein the collar front wall (34) has a recess (44) which is delimited by an edge (40) of the collar and which is filled in by a correspondingly designed folding tab (47) which adjoins an inner side of a lid upper wall (27) in a finished pack.

6. The blank as claimed in claim 3, wherein the collar side tabs (35, 36) are provided with inclined edges (49) which correspond to inclined lines (50) of tabs (25) of the pack part (18), such that the blank can be severed from a web of material without any waste.

7. The blank as claimed in claim 4, wherein the collar from wall (34) has a recess (44) which is delimited by an edge (40) of the collar and which is filled in by a correspondingly designed folding tab (47) which adjoins an inner side of a lid upper wall (27) in a finished pack.

8. The hinge-lid pack as claimed in claim 2, wherein the lid inner tab (33) is dimensioned such that the residual connections (38,39) extend in a region of a folding line (16) between the lid from wall (28) and the lid upper wall (27).

9. The hinge-lid pack as claimed in claim 8, wherein the residual connections (38, 39) extend at both sides of a folding tab (47) which is connected to the lid inner tab (33) and which extends in a recess (44) of the collar from wall (34).

10. A blank for the production of hinge-lid packs for the accommodation of cigarettes (10), with a main blank (14) forming a pack part (18) and a lid (19) connected thereto, the lid (19) being provided with a lid front wall (28) and a lid inner tab (33) connected to the inner side of the lid from wall (28), wherein:

a) a collar (15) having a collar from wall (34) and collar side tabs (35, 36) is connected in one piece to the main blank (14);

b) the collar (15) is connected to the lid inner tab (33) in a region of the collar front wall (34) via two residual connections (38, 39);

c) the residual connections (38, 39) are arranged adjacent to lateral edges (41 ) of the lid inner tab (33), and at both sides of a recess (44) of the collar front wall (34); and d) the lid inner tab (33) is connected in one piece to the lid front wall (28) which is connected in one piece to a lid upper wall (27).

11. The blank as claimed in claim 10 wherein the recess (44) of the collar from wall (34) is delimited by an edge (40) of the collar (15) and filled in by a correspondingly designed folding tab (47) which is connected to the lid inner tab (33) and which adjoins the inner side of the lid upper wall (27) in a finished pack.

12. The blank as claimed in claim 10, wherein the collar side tabs (35, 36) are provided with inclined edges (49) which correspond to inclined edges (50) of side tabs (25) of the pack part (18), such that the blanks can be severed from a web of material without any waste.

13. The blank as claimed in claim 11, wherein the collar side tabs (35, 36) are provided with inclined edges (49) which correspond to inclined edges (50) of side tabs (25) of the pack part (18), such that the blanks can be severed from a web of material without any waste.

* * * * *